United States Patent [19]

Moss

[11] Patent Number: 4,955,154

[45] Date of Patent: Sep. 11, 1990

[54] ANTI-THEFT IDENTIFICATION DETERRENT FASTENER

[76] Inventor: Nathan S. Moss, 98 Silver Lake Rd., Staten Island, N.Y. 10301

[21] Appl. No.: 382,387

[22] Filed: Jul. 20, 1989

[51] Int. Cl.[5] ..... G09F 3/08

[52] U.S. Cl. ..... 40/663; 40/643; 40/911

[58] Field of Search ..... 40/663, 643, 911, 912, 40/642, 628, 629

[56] References Cited

U.S. PATENT DOCUMENTS

| | | | |
|---|---|---|---|
| 414,205 | 11/1889 | Frauenberger | 40/629 X |
| 1,400,155 | 12/1921 | Greenburg | 40/663 |
| 1,460,282 | 6/1923 | Shill | 40/911 X |
| 1,887,324 | 11/1932 | Pocordsa | 40/629 |
| 3,645,022 | 2/1972 | Anderson | 40/642 |
| 3,879,876 | 4/1975 | Morgan | 40/629 X |

*Primary Examiner*—James R. Brittain

*Attorney, Agent, or Firm*—Richard L. Miller

[57] ABSTRACT

An anti-theft identification deterrent fastener that includes a housing with a recessed identification label firmly secured within for securement into a cutout area in an auto, a truck, or other device part. If the housing and the label are removed therefrom or tampered with it will indicate that the part has been stolen.

4 Claims, 1 Drawing Sheet

ANTI-THEFT IDENTIFICATION DETERRENT FASTENER

BACKGROUND OF THE INVENTION

The instant invention relates generally to theft prevention devices and more specifically an anti-theft identification deterrent fastener.

Numerous theft prevention devices have been provided in the prior art that are adapted to prevent removal or tampering of items such as in containers holding various objects. While these units may be suitable for the particular purpose to which they address, they would not be as suitable for the purpose of the present invention as hereafter described.

SUMMARY OF THE INVENTION

A primary object of the present invention is to provide an anti-theft identification deterrent fastener that will overcome the shortcomings of the prior art devices.

Another object is to provide anti-theft identification deterrent fastener that utilizes bar codes, individual numbered or specially identified attaching hardware to identify auto and truck parts that are removed from stolen cars and trucks.

An additional object is to provide an anti-theft identification deterrent fastener that when altered or removed will indicate to buyer of auto, truck or other device parts that these parts have been stolen.

A further object is to provide an anti-theft identification deterrent fastener that is simple and easy to use.

A still further object is to provide an anti-theft identification deterrent fastener that is economical in cost to manufacture.

Further objects of the invention will appear as the description proceeds.

To the accomplishment of the above and related objects, this invention may be embodied in the form illustrate in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
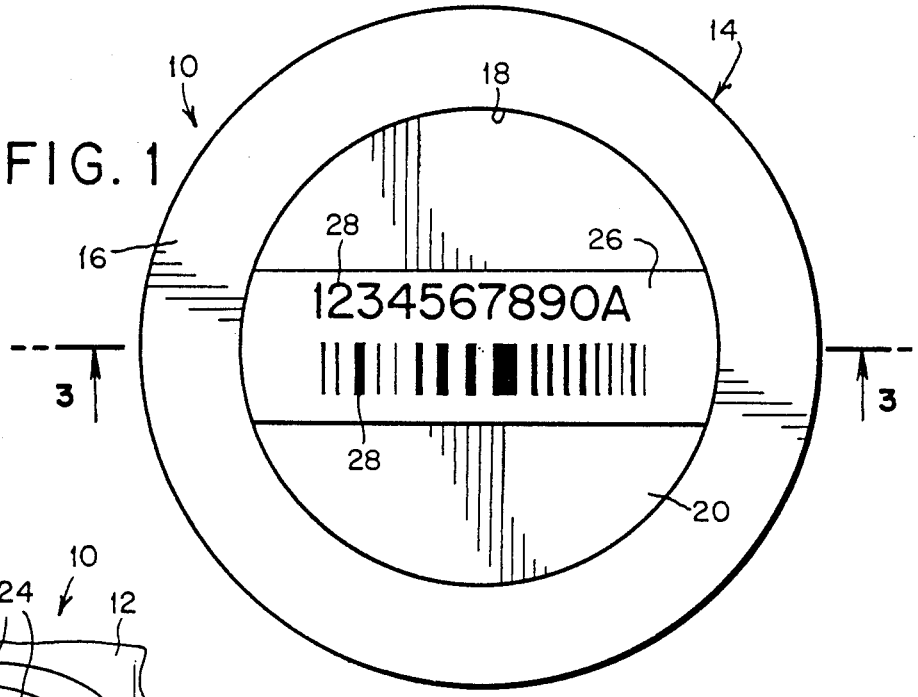
FIG. 1 is an enlarged top plan view of the instant invention.
Figure 2:
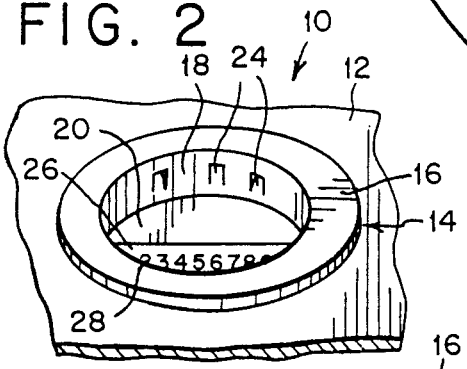
FIG. 2 is a fragmentary view of a typical part, showing the instant invention installed therein.
Figure 3:
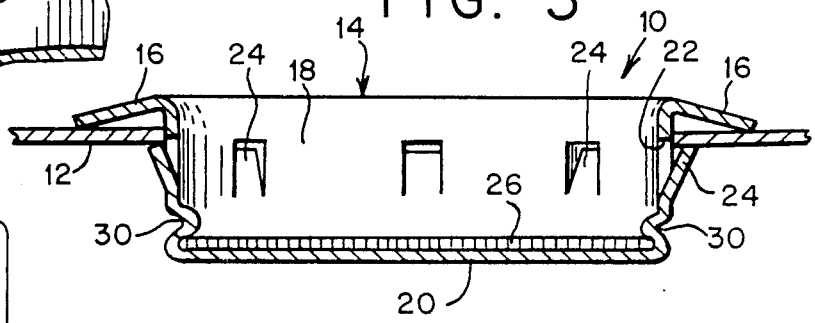
FIG. 3 is a cross sectional view taken on line 3—3 of FIG. 1.

Turning now descriptively to the drawings, in which like reference characters denote like elements throughout the several views, FIGS. 1 through 3 illustrate an anti-theft deterrent fastener 10 for an auto, a truck, or any device, or any part 12. The fastener 10 contains a housing 14 that has a raised flange 16 there about, a side wall 18 and a bottom wall 20 which will fit into the auto, truck, or any device, or any part 12 that has a corresponding cutout area 22.

A plurality of spring projections 24 are formed out of and outwardly extend from the side wall 18 below the flange 16 so that the housing 14 can snap into the cutout area 22 of the part 12 with the spring projections 24 preventing easy removal therefrom. The spring projections 24 on the side wall 24 lock the flange 16 of the housing 14 onto the cutout area 22 of the auto, truck, or any device, or any part 12 to prevent tampering of the housing 14.

An identification label 26 is affixed to the bottom wall 20 and includes indicia 28, such as a bar code thereon to indicate proper ownership of the part 12, the housing 14 is attached to.

A crimp portion 30 is formed between the side wall 18 and the bottom wall 20 so as to hold two ends of the identification label 26 firmly thereto. The crimp portion 30 between the side wall 18 and the bottom wall 20 secures the label 26 thereto to prevent tampering of the label.

Figure 4:
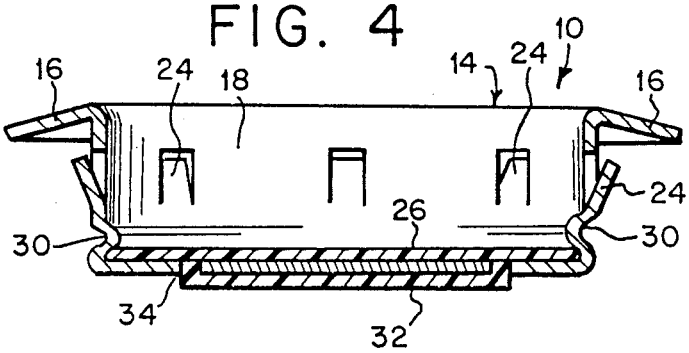
FIG. 4 is similar to FIG. 3, but showing another embodiment of the invention.

FIG. 4 shows a modified anti-theft deterrent fastener 10 in which the identification label 26 is a plastic insert 32 with a portion 34 embedded within and between the bottom wall 20 so as to be more firmly held thereto.

Figure 5:
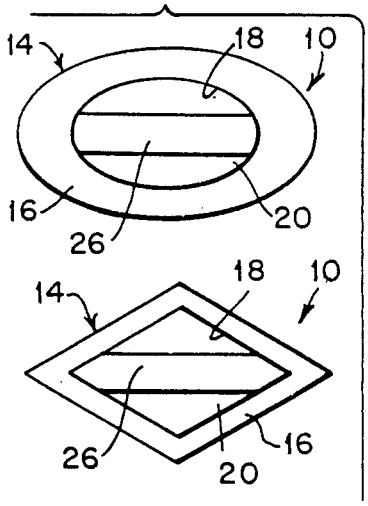
FIG. 5 is a diagrammatic plan view showing typical modified shapes of the invention.

The fastener 10 can be round as shown in FIGS. 1 and 2, oval as in FIG. 5 or diamond shaped as in FIG. 5. Other shapes not shown can also be utilized as long as the cutout area 22 is of the same general shape and properly sized to fit correctly.

The anti-theft concept is in the nature of the fastener 10 itself. If a part 12 is removed from a vehicle and sold separately, the bar code identification 28 or serial number by law must be visible. An impression stamped serial number can be ground off and the area re-stamped and repainted. If the fastener 10 is removed there will be the cutout area 22 left in the part 12. Any attempt to replace the cutout area 22 with a plug will be very visible and easily noticed by casual observation. Law enforcement people will therefore know that this part 12 is stolen. If the label 26 with indicia 28 is defaced or removed it will alert persons that this is an attempt to sell a stolen part 12 as part of a repair job.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An anti-theft identification deterrent fastener for a part which comprises:

(a) a housing having a raised flange there about, a side wall and bottom wall which will fit into the part having a corresponding cutout area;

(b) means on said side wall for locking said flange of said housing onto the cutout area of the part to prevent tampering of said housing, wherein said locking means includes a plurality of spring projections formed on a side of said sidewall and outwardly extending from said side wall below said flange so that said housing can snap into the cutout area of the part with said spring projections preventing easy removal therefrom;

(c) an identification label affixed to said bottom wall; and (d) means between said side wall and said bottom wall for securing said label thereto to prevent tampering of said label.

2. An anti-theft identification deterrent fastener as recited in claim 1, wherein said identification label includes indicia thereon to indicate proper ownership of the part said housing is attached to.

3. An anti-theft identification deterrent fastener as recited in claim 2, wherein said label securing means includes a crimp portion formed between said side wall and said bottom wall so as to hold two ends of said identification label firmly thereto.

4. An anti-theft identification deterrent fastener as recited in claim 3, wherein said identification label is a plastic insert with a portion embedded within and between said bottom wall so as to be firmly held thereto.

* * * * *